United States Patent [19]

Drummond

[11] Patent Number: 5,076,440

[45] Date of Patent: Dec. 31, 1991

[54] EASY-OPEN CONTAINER HAVING IMPROVED LABEL

[75] Inventor: Michael T. Drummond, Florence, S.C.

[73] Assignee: Sonoco Products Company, Hartsville, S.C.

[21] Appl. No.: 687,755

[22] Filed: Apr. 19, 1991

[51] Int. Cl.[5] ..... B65D 3/26

[52] U.S. Cl. ..... 229/202; 493/301; 229/203; 229/245; 206/830

[58] Field of Search ..... 206/627, 629, 605, 606; 493/299, 301

[56] References Cited

U.S. PATENT DOCUMENTS

| | | | |
|---|---|---|---|
| 2,234,013 | 3/1941 | Stover | 206/629 |
| 2,775,394 | 12/1956 | Lucas, Jr. | 206/629 |
| 2,775,395 | 12/1956 | Bergstrom | 206/629 |
| 2,793,126 | 5/1957 | Fienup | 206/629 |
| 2,795,366 | 6/1957 | Magill | 206/627 |
| 3,093,293 | 6/1963 | Freese | 206/606 |
| 3,102,818 | 9/1963 | Zoeller et al. . | |
| 3,109,576 | 11/1963 | Karl | 206/629 |
| 3,159,515 | 12/1964 | Dunlap, Jr. et al. | 493/301 |
| 3,165,985 | 1/1965 | Pottle | 493/299 |
| 3,195,427 | 7/1965 | Adams | 493/299 |
| 3,214,078 | 10/1965 | Leezer | 206/629 |
| 3,221,975 | 12/1965 | Zoeller et al. . | |
| 3,241,739 | 3/1966 | Ahlemeyer | 206/627 |
| 3,280,709 | 10/1966 | Elam | 493/301 |
| 3,304,185 | 2/1967 | Fortney | 206/606 |
| 3,331,549 | 7/1967 | Beasley | 493/299 |
| 3,397,834 | 8/1968 | Hanlon et al. | 206/627 |
| 3,524,779 | 8/1970 | Masters et al. | 493/299 |
| 3,940,496 | 2/1976 | Turpin et al. . | |
| 3,972,468 | 8/1976 | Reid . | |

*Primary Examiner*—Stephen Marcus
*Assistant Examiner*—Chris McDonald
*Attorney, Agent, or Firm*—Bell, Seltzer, Park & Gibson

[57] ABSTRACT

The invention is directed to easy-open containers for products such as dough which have an easy-open seam extending helically between the end of the container body. A helically wound outer label of flexible sheet material in strip form has at least one longitudinal edge folded onto and bonded to the main body of the label to thereby provide a reinforced longitudinal edge portion of the outer label comprising at least two layers of the flexible sheet material. The reinforced longitudinal edge portion of the outer label is positioned in bridging relation to the easy-open seam of the bodywall to thereby maintain the easy-open seam closed and provide a peel strip for exposing the easy-open seam for opening of the container body.

29 Claims, 4 Drawing Sheets

EASY-OPEN CONTAINER HAVING IMPROVED LABEL

FIELD OF THE INVENTION

The invention relates to easy-open containers for products such as biscuit and bread dough and the like. More specifically, the invention relates to easy-open containers having a helically wound body wall and having an easy-open seam extending helically between the ends of the container.

BACKGROUND OF THE INVENTION

Composite containers for packaging products under pressure, particularly, refrigerated dough products, constitute a significant commercial consumer product. Typically, the containers are formed of a helically wound paperboard or boardstock layer; an interior layer which is a laminate including kraft paper, foil and/or polymer layers; and an exterior label. The helically wound boardstock layer includes an unglued butt joint formed by the adjacent edges of the boardstock extending helically from end to end of the can. The exterior label surrounds the boardstock and covers the butt joint thereby preventing the premature opening of the butt joint.

Commercially significant containers of this type are disclosed in U.S. Pat. No. 3,981,433 to Thornhill et al. which is directed to one-step easy-open containers including an inner liner having a helical pleat positioned opposite the unbonded helical butt joint. When the outer wrapper is removed, the dough and liner expand outwardly together as the liner pleat begins to unfold. The resultant pressure on the can body causes the butt joint to open. This in turn automatically allows the inner liner to expand further. The liner is automatically opened by the rapidly expanding dough to thereby allow access to the dough in the interior of the container.

The outer label surrounding the butt joint in containers of this type is an important structural component of the container because the outer label bridges the butt joint and maintains it in the closed position. Accordingly, the label must be strong in order to prevent premature opening of the container. In addition, liquids from the product in the container, e.g. dough, can seep out of the product into the ends of the easy-open seam and be channeled down the seam. The label must also be able to withstand exposure to such liquids. These structural requirements for the label prevent the use of more economical low strength sheet materials for construction of the label.

The outer label must also be easily removable in order to expose the easy-open seam for opening of the container. Typically, the label includes a tab for grasping by the consumer, and which when pulled, initiates a tear in the outer label allowing the label to be removed in whole or in part sufficiently to expose the easy-open seam. However, if the tab is pulled carelessly by the consumer, the label can tear in the wrong direction and only a portion of the easy-open seam may be exposed. In such instances, removal of the remaining portion of the label covering the easy-open seam and the opening of the container body can be frustrating to the consumer.

When a thick kraft paper is used in the outer label to meet the structural requirements for the label, still another difficulty can be created. As the label is pulled away from the can body, the thick kraft paper can split into layers, between its outside and inside surfaces. In this case, only the outer portion of the label is removed leaving a thin paper layer covering the easy-open scam. Removal of this thin layer can be particularly difficult.

Numerous modifications have been proposed for easy-open spirally wound composite containers. For example, an easy-open container having a spirally wound lap joint is proposed in U.S. Pat. No. 3,221,975 to Zoeller et al. The overlapping edge of the joint is permanently clued to the underlying ply. A plurality of discontinuous perforations are provided in the overlapping seam so that the overlapping seam itself, forms a tear strip for opening of the container.

It has also been proposed to provide a separate reinforcing strip bonded to the container body in overlapping relation to the butt joint. Such separate tensile members are proposed in U.S. Pat. No. 3,102,818 to Zoeller; U.S. Pat. No. 3,972,468 to Reid; and in U.S. Pat. No. 3,940,496 to Turpin et al. The use of separate tensile members bridging the butt joint provides improved strength across the butt joint and can allow for the use of lighter weight outer label sheet materials. However, the addition of the separate tensile member increases the costs of the container and complicates the manufacturing process.

Despite these and numerous other proposals for modifying the known spirally wound easy-open containers, commercially available easy-open containers still typically employ a relatively thick outer label construction which adds to the costs of the container and, in addition, removal of the outer label is not always accomplished in a reliable fashion to ensure exposure of the easy-open seam of the container body.

SUMMARY OF THE INVENTION

This invention provides easy-open containers for products such as dough having enhanced reinforcement at the easy-open seam of the container, and in addition, provides a reliable construction for assuring exposure of the easy-open seam during removal of the outer label of the easy-open container. Easy-open containers provided according to the invention can employ any number of inexpensive or readily available materials for construction of the outer label. The improved easy-open containers of the invention can in preferred embodiments be provided with thinner and/or more economical outer label constructions while exhibiting equivalent or greater strength as compared to conventional easy-open containers. The easy-open containers provided according to the invention can be manufactured using conventionally available spiral winding manufacturing equipment and conventional boardstock, conventional inner linear materials, and conventional closure members.

The easy-open containers of the invention include a helically wound paperboard bodywall defining a substantially cylindrical container body having opposed ends. The edges of the paperboard bodywall are adjacent each other to define an easy-open seam extending helically between the ends of the container body. A helically wound outer label of flexible sheet material in strip form is bonded to at least a portion of the outer surface of the body wall with at least one longitudinal edge of the outer label being folded onto and bonded to the main body of the label to thereby provide a reinforced longitudinal edge portion of the outer label which includes at least two layers of the flexible sheet material. The reinforced edge portion of the outer label is positioned in bridging relation to the easy-open seam of the bodywall substantially from end to end of the container body. Preferably, the outer surface of the label is an impervious material, e.g. a plastic film or lacquer coating, and the longitudinal edge is folded underneath the main portion of the label strip. This results in the provision of an impervious face on the underside of the reinforced edge portion of the label. Thus the face of the edge of the label which contacts the easy-open seam is impervious and less susceptible to be attacked by liquids.

Because the reinforced portion of the outer label overlaps the easy-open seam, the strength of the outer label is concentrated over the easy-open seam where it is needed to hold the can together until the consumer opens the can. The reinforced portion of the outer label is also provided at the location where strength is needed to resist liquid attack. When the container is opened by removal of the outer label, the reinforced edge portion of the outer label provides a peel strip or tear strip to insure proper removal of the portions of the outer label overlying the easy-open seam. Because the outer label is thicker in the portions overlying the easy-open seam, the tendency of the outer label to tear improperly during its removal is minimized. Thus, a tab cut can be provided through all or a portion of the reinforced edge of the outer label near one end of the can and when the consumer pulls the tab the greater strength of the overlapped portions of the outer label cause this portion of the label to hold together. The continued pulling of the strip results in either the material next to the strip to tear or in the entire label being peeled away from the can body. Once the easy-open seam is exposed, the can will either self-open or the consumer can apply a gentle pressure along the easy-open seam to cause opening of the can.

In one preferred embodiment of the invention, the reinforced longitudinal edge portion of the outer label overlaps and is bonded to the other longitudinal edge, i.e. the trailing edge of the outer label, which in turn, is bonded to the outer surface of the can body adjacent the easy-open seam from end to end of the container body. The reinforced longitudinal edge of the outer label can be bonded to the opposite, trailing edge of the outer label using any of various types of adhesives, and in one advantageous embodiment, can be bonded to the opposite trailing edge using a releasable bond such as a peelable heat seal or a frangible adhesive so that the peel strip can be readily pulled away from the easy-open seam during opening of the can body. Advantageously, a portion of the reinforced longitudinal edge near the top of the container is not bonded to the corresponding trailing edge of the outer label and a tab cut is provided through all or a portion of this unbonded portion of the reinforced edge so that an unbonded tab is readily available and apparent to the consumer for grasping and pulling to remove the portion of the outer label overlying the easy-open seam.

The reinforced folded edge portion of the outer label can be folded only once thus providing a reinforced edge having a thickness of two layers, or it can be folded many times to provide a reinforced edge several layers thick depending upon the material used for the outer label and the desired strength for the peel strip. Extremely economical and environmentally acceptable materials such as paper may require many folds to acquire sufficient strength to function as both a peel strip and to hold the butt joint closed until the consumer removes the peel strip. Other material combinations such as kraft, plastic, or foil may use fewer folds. Because the strength in the folded area can be readily varied by the number of folds, a wide range of materials and material constructions are available for use as the main body of the outer label.

The improved easy-open containers according to the invention can employ the conventional butt jointed easy-open seam construction in which the adjacent opposite edges of the helically wound paperboard bodywall are unbonded to each other. Alternatively, the easy-open containers provided according to the invention can employ the overlapped can body construction disclosed in U.S. application Ser. No. 07/621,219, filed Nov. 30, 1990 by Michael T. Drummond, et al. and directed to "Easy-Open Container for Refrigerated Dough Products and the Like" which is incorporated herein by reference in its entirety. In the containers provided therein, the adjacent edges of the helically wound body wall are overlapped and a temporary adhesive between the overlapped edges of the bodywall releasibly adheres the overlapped edges of the bodywall together. Such overlapped easy-open seams provide greater strength to the container body. By employing the outer label construction of this invention which has a reinforced edge overlying the easy-open seam, even greater strength can be provided to the composite easy-open container.

The easy-open containers provided according to this invention are not substantially different in appearance or in the manner of opening from the familiar and commercially available easy-open containers. Nevertheless, the easy-open containers of this invention can employ a more economical outer label construction and can minimize or eliminate the problem of incomplete or improper outer label removal. The closure of the easy-open seam in the easy-open can body can be improved and strengthened in the containers of this invention but no separate tensile member for coverage of the easy-open seam is required. The containers of this invention provide the manufacturer with a great variety of choices of outer label materials, adhesives and can body constructions.

BRIEF DESCRIPTION OF THE DRAWINGS

In the drawings which form a part of the original disclosure of the invention.

DETAILED DESCRIPTION OF THE PREFERRED EMBODIMENT

In the following detailed description, various preferred embodiments of the invention are described. It will be understood, however that the invention is not limited to its preferred embodiments and although specific terms are employed in describing the preferred embodiments, these are used for the purposes of illustration only and not for the purposes of limitation. It will thus be apparent that the invention includes various alternatives, modifications and equivalents within its spirit and scope.

Figure 1:
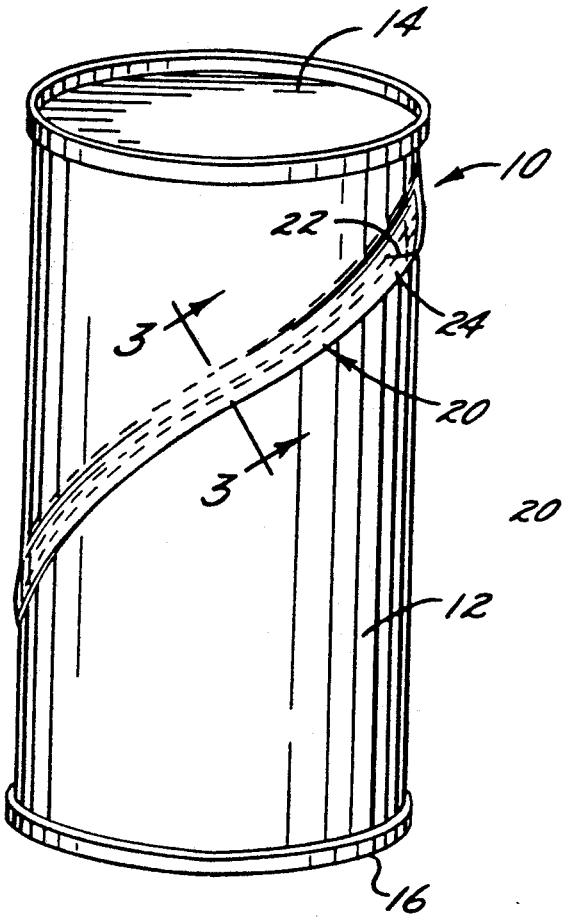
FIG. 1 is a perspective view of an easy-open container provided according to one preferred embodiment of the invention.
Figure 2:
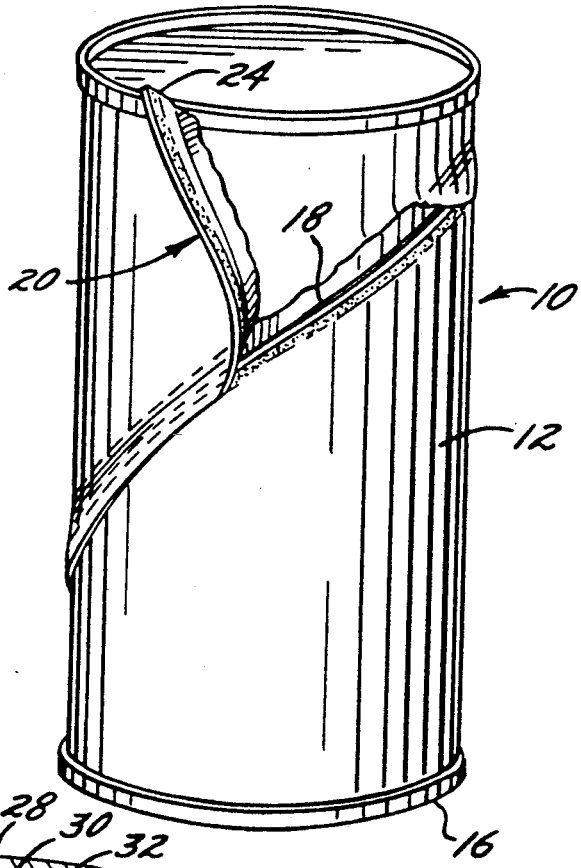
FIG. 2 is a perspective view of the easy-open container of FIG. 1 illustrating functioning of the reinforced edge of the outer label as a tear strip for removal of the portion of the outer label covering the easy-open seam.

FIGS. 1 and 2 illustrate in perspective, a preferred easy-open container 10 provided according to the invention. As seen from the outside, container 10 is of substantially cylindrical form and includes a spirally wound outer label 12. A top end closure 14 and a bottom end closure 16 are provided on the opposed ends of the container. An easy-open seam 18 is provided in the body wall of the container beneath the thickened longitudinal edge 20 of the outer label 12. A short tab cut 22 is provided through the thickened longitudinal edge 20 of the outer label near the top closure member 14 and extending for a short distance in the circumferential direction around the top of the can. This allows the consumer to grasp tab 24 and to peel the thickened longitudinal edge 20 of the outer label 12 so that the thickened longitudinal edge 20 functions as a tear strip. Because the thickened longitudinal edge 20 is stronger than the main body of outer label 12, the tab has improved strength and is unlikely to simply be torn away by the grasp of the consumer. Instead, as shown in FIG. 2 the thickened longitudinal edge 20 is removed from the can body to expose the easy-open seam 18.

Although the tab cut 22 is shown in FIGS. 1 and 2 as being at the top of the container body, the tab cut 22 can alternatively or concomitantly be provided at the bottom end of the container body. Providing the tear tab at the bottom of the label can be especially helpful when only the tear strip and not the entire label is to be removed from the container.

Figure 3:
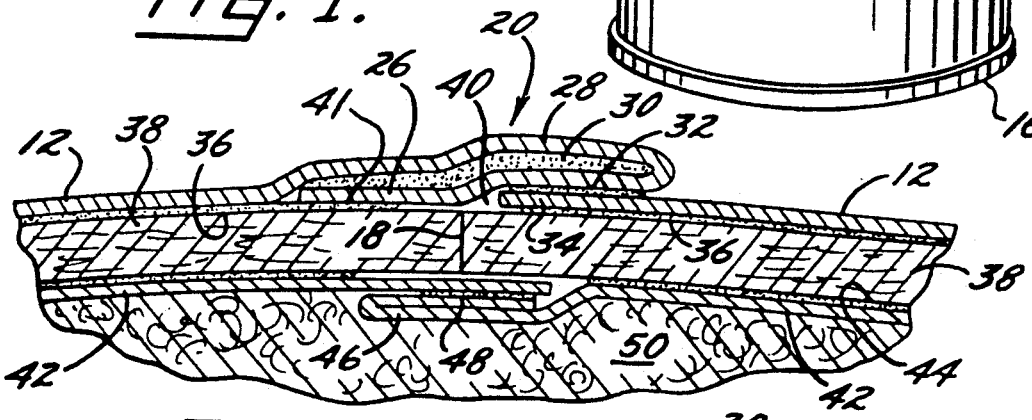
FIG. 3 is a greatly enlarged fragmentary sectional view taken along line 3—3 of FIG. 1 and illustrates construction of the reinforced edge portion of the outer label and its relation to the easy-open seam together with one preferred construction for the easy-open joint and the body wall liner.

The construction of thickened longitudinal edge 20 and easy-open seam 18 is best seen in FIG. 3 which is a greatly enlarged fragmentary cross sectional view taken along line 3—3 of FIG. 1. Thickened longitudinal edge 20 of outer label 12 is formed by folding over a portion 26 of the longitudinal edge of the outer label onto a second portion 28 of the outer label 12 to thereby provide longitudinal edge portion 20 which includes two layers 26 and 28 of the material forming outer label 12. Layers 26 and 28 are permanently bonded to each other via a permanent glue layer 30.

A portion of the underside of the leading edge of the reinforced longitudinal edge portion 20 is bonded via bond layer 32 to the outside surface of the trailing longitudinal edge 34 of outer label 12. Bond layer 32 is advantageously of relatively weak bond strength so that it can readily be peeled apart to expose easy-open seam 18. Bond layer 32 can be a peelable heat seal or can be formed by a frangible adhesive such as a low strength dextrine or a high-solids adhesives, or can be an interrupted, irregular bonding such as spot bonding.

Outer label 12 can be constructed of any of various flexible sheet materials such as paper, kraft, plastic film, film/foil laminates, paper/foil laminates, paper/film laminates and the like. Depending upon the strength of the flexible sheet material and the desired strength of the reinforced longitudinal edge portion of the outer label, the reinforced edge portion 20 can be formed by folding repeatedly the longitudinal edge upon itself to form a longitudinal edge portion of many layers or it can be folded only a single time as illustrated in FIG. 3. When bond layer 32 which joins the reinforced longitudinal edge portion 20 of outer label 12 the trailing edge 34 of the outer label is a peelable heat seal, a heat sealable material can be applied to the edge of the label sheet as a printed layer as discussed in detail hereinafter.

Returning to FIG. 3, the underside of outer label 12 is bonded via a permanent or frangible adhesive layer 36 to the outer surface of paperboard bodywall 38. In some instances, it may be desirable that the main portion of the outer label remain adhered to the bodywall following removal of the reinforced longitudinal edge 20 of the outer label. In such cases, adhesive layer 36 can constitute a permanent adhesive. Alternatively, where it is desirable that all or a portion of the outer label 36 be removed, adhesive layer 36 can be formed of a frangible adhesive such as dextrine or a high-solids content adhesive. When a frangible adhesive is employed, the frangible adhesive can extend fully across butt joint 18 and completely fill unbonded area 40 of FIG. 3. Moreover, in such instances bond layer 32 and bond layer 36 can be formed from the same frangible adhesive material.

As seen in FIG. 3, a portion of the trailing end of the reinforced longitudinal edge 20 is bonded to the bodywall 38 via adhesive layer 41 which can be the same or different as adhesive layer 36. Bonding of all or a portion of the trailing edge of the reinforced edge portion to the bodywall is preferred for increasing the performance of the longitudinal edge in keeping the easy-open seam in the closed configuration.

Inner liner 42 is advantageously a barrier type, flexible sheet material such as polymer/foil; a kraft/foil/-polymer; a polymer/polymer; kraft/polymer (with a metallized layer) polymer heat seal layer; or a kraft/foil laminate. The barrier sheet inner liner prevents the escape of liquids, oils and preferably, gases into or out of the container wall. A permanent adhesive layer 44 is provided between the inner liner 42 and the container body 38. An expandable fold or pleat 46 is provided in overlapping relation to butt joint 18 and is heat sealed to an overlapping edge of liner 42 via a heat seal 48 which as illustrated in FIG. 3 extends along only a portion of the underside of fold 46. As discussed in detail later, fold 46 can readily unfold due to dough pressure and is provided to assist in allowing the food product such as dough 50 contained within the container to expand, thereby forcing open the butt joint 18.

The bodywall 38 is advantageously composed of a conventional helical winding paperboard or boardstock having a thickness of between about 0.10 and 0.35 inch, preferably from about 0.15 to 0.30 inch, for example, 0.021 inch. Boardstock conventionally used in the manufacture of spiral wound containers is commercially available from various manufacturers including Sonoco Products Corporation; Republic Paperboard Corporation and Middletown Board Corporation. In order to function advantageously as the spirally wound bodywall, the boardstock is typically composed of kraft or recycled paper and can typically range from, for example 50 to 100 lbs/ream. In some instances, the boardstock can include a weak exterior layer, for example, a 0.003 inch thickness exterior news layer.

Figure 3A:
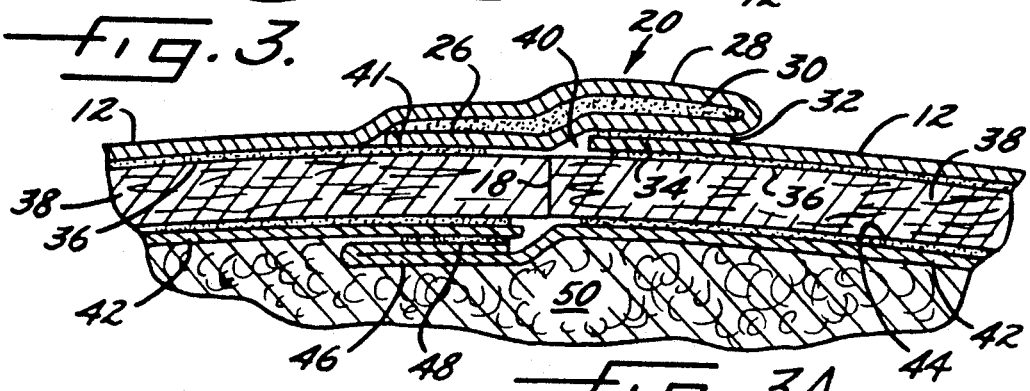
FIG. 3A is an alternative butt joint construction for the easy-open container of FIGS. 1 and 2 wherein the helical pleat of the liner is located adjacent and not covering the butt joint.

FIG. 3A illustrates an alternative construction to the construction shown in FIG. 3, the difference being that expandable pleat 46 is offset by a slight amount from butt joint 18. By providing the expandable pleat 46 at a location adjacent and not overlapping butt joint 18, the easy-open seam requires a slightly greater pressure to open. This can be advantageous when the material 50 packed inside the container is under a greater pressure or when it is desired that the container not be self-opening. In such instances, the container can be opened by the consumer following exposure of the outer surface of the butt joint by a gentle pressing on the easy-open seam.

Figure 4:
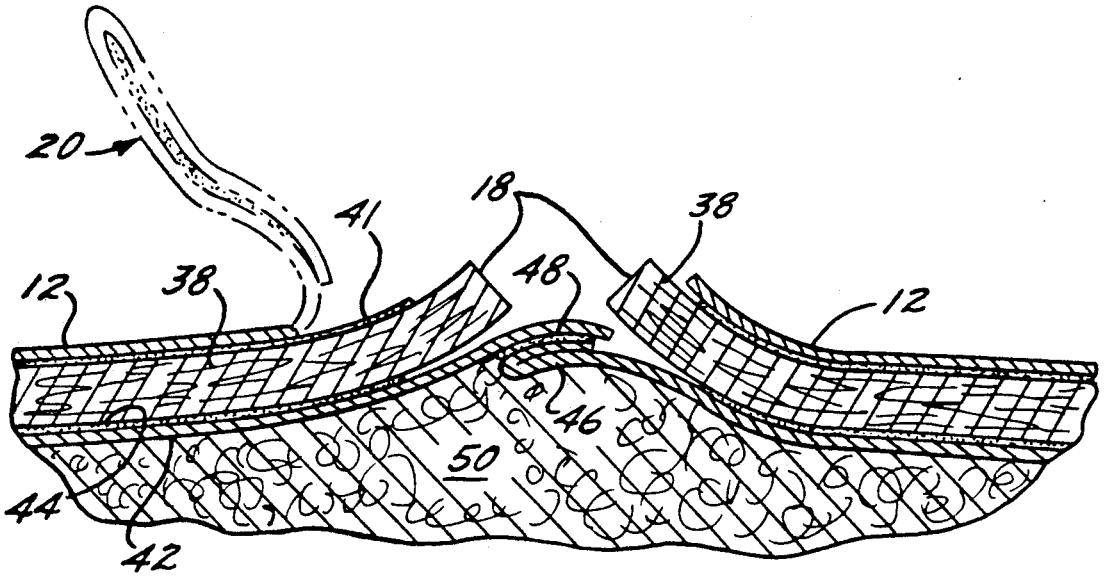
FIGS. 4 and 5 are cross-sectional views illustrating the manner in which the container automatically opens along the easy-open seam following removal of the longitudinal edge of the outer label covering the easy-open seam.
Figure 5:
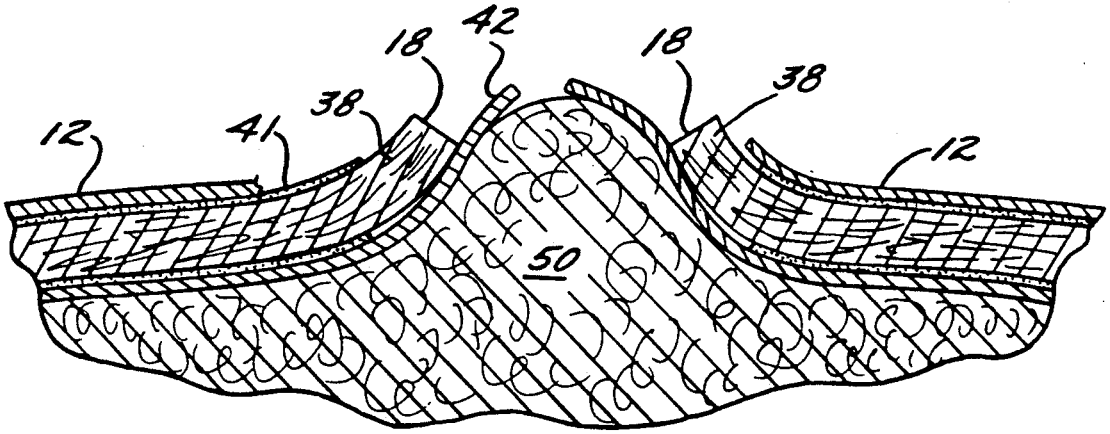

FIGS. 4 and 5 illustrate opening of the butt jointed easy-open seam 18 following removal of the reinforced longitudinal edge 20 of outer label 12. With reference to FIG. 1, the reinforced longitudinal edge 20 is peeled away by the consumer grasping tab 26. As the reinforced longitudinal edge 20 is peeled away from the container body 38, the dough or other material 50 which is maintained under a pressure of, for example, 15–40 psi, exerts outward pressure on the container bodywall. The expandable fold 46 begins to unfold at the unsealed portion, first, thereby allowing dough 50 to expand. As the fold 46 begins to unfold, the circumferential size of the liner increases thus causing the butt joint 18 to begin opening as shown in FIG. 4.

As shown in FIG. 5, the dough 50 continues to expand until liner 42 peels along heat seal 48 thereby allowing access by the consumer to the dough 50 inside the container.

Figure 6:
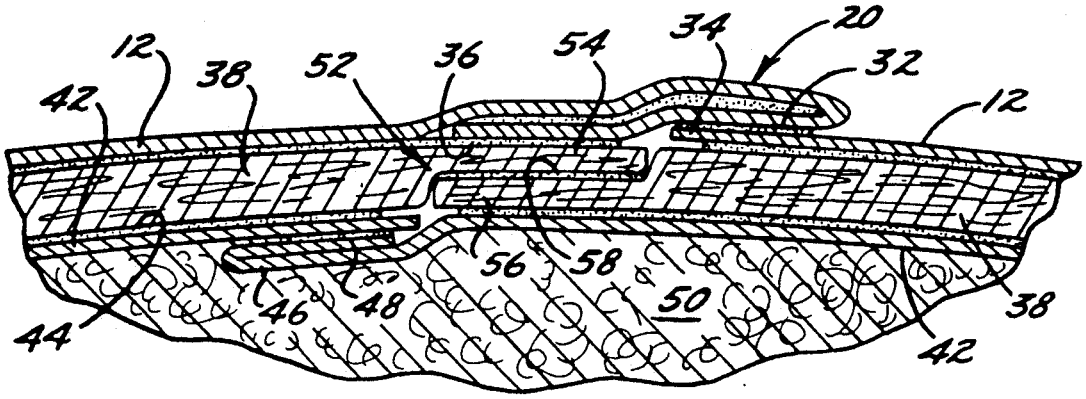
FIG. 6 is a greatly enlarged fragmentary cross-sectional view illustrating an alternative construction for the easy-open seam of the container of the invention wherein an overlapped temporarily bonded joint is substituted for the butt joint of FIGS. 3-5.

FIG. 6 illustrates another preferred embodiment of the invention in which reinforced longitudinal edge portion 20 of outer label 12 is superimposed over an overlapped easy-open seam 52. As in the previous embodiments of the invention, the composite container body includes an outer label layer 12, a bodywall layer 38 and an inner liner layer 42. The easy-open joint 52 is formed from overlapping bodywall edges 54 and 56. An adhesive layer 58 is provided between the overlapping bodywall edges 54 and 56. Adhesive layer 58 is advantageously a temporary adhesive material which provides temporary bonding of the overlapped edges 54 and 56 during the manufacturing operation, but which dries to a layer of low adhesive strength so that easy-open seam 52 is provided by the overlapping edges of the body stock. Preferably, each of the overlapping edges 54 and 56 of the bodywall 38 are compressed to a thickness less than the thickness of the main bodywall 38. Compression of the overlapping edges is advantageous in that the bodywall thickness is not substantially increased at the overlapped joint. In addition, compression of the overlapped edges decreases penetration of the temporary adhesive into the overlapped edges, which, in turn improves the release properties of the adhesive layer 38 and in addition prevents oils and liquids which may escape from the dough 50 from penetrating into the easy-open seam 52.

Various adhesives can be employed to provide temporary adhesive layer 58 including a high initial tack dextrine based adhesive commercially available from National Starch and Chemical Corporation, Grand Prairie, Texas as "71-5626B". This is a high solids (about 64%), high viscosity (about 2100 cps) acid modified (about 2.5 Ph) dextrine adhesive. Other frangible adhesives which can be successfully used for adhesive layer 58 include heavily filled, resinous, aqueous emulsion type adhesives such as, for example polyvinylacetate dispersed in water together with a tackifying alcohol and an inert filler such as clay, silicon dioxide calcium carbonate, talc and the like. The inert filler can insure that a weak discrete layer of adhesive remains between the overlapping edges of the container body to thereby provide for the fracture or breaking or the adhesive. In the alternative, a release coating, such as a microcrystalline wax, silicone or the like can be provided on the inner surface on either or both of the overlapping edges 54 or 56 or the container bodywall so that the adhesive layer is readily released upon drying. Moreover, although compressed bodywall edges 54 and 56 are shown in FIG. 6, other overlapping arrangements can be used such as those in which the bodywall edges are not compressed, or are bevelled or are similarly arranged in overlapping relation. Containers comprising such overlapped easy-open joints are disclosed in U.S. application Ser. No. 07/621,219, filed Nov. 30, 1990 by Michael T. Drummond et al. and entitled "Easy-Open Container For Refrigerated Dough Products And The Like", which is incorporated herein by reference.

Figure 7:
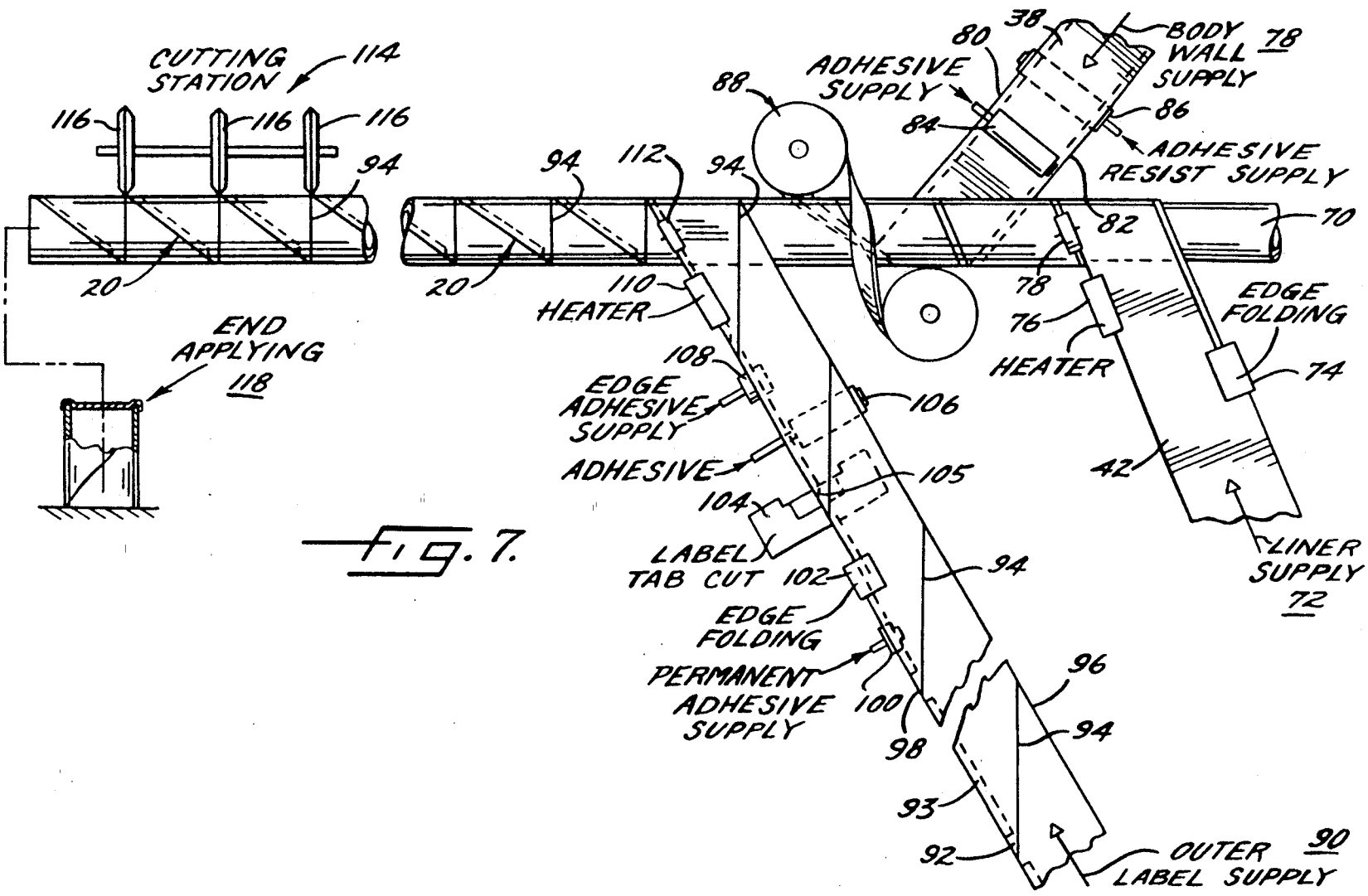
FIG. 7 is a diagrammatic view which illustrates a preferred method and apparatus for producing the easy-open containers provided according to the invention.

FIG. 7 illustrates the manufacture of containers according to preferred process embodiments of the invention. Initially, inner liner sheet material 42 is wound around stationary mandrel 70. As the liner 42 is supplied from supply 72 to mandrel 70, it passes across an edge folding means, such as a folding tongue 74. A portion of the other edge of liner 42 is heated by means of a heater 76. A pressure roll 78 applies pressure to the heated edge of the liner thereby bonding the liner to itself at the leading edge of fold 46 (FIG. 3).

The container bodywall 38 is supplied from source 78. When the longitudinal edges of the body wall 38 are to be overlapped, the edges, 80 and 82 are advantageously compressed by a compression roll (not shown) prior to winding on the mandrel. In such instances, a frangible adhesive is applied to each compressed edge via an adhesive applicator (not shown). An adhesive applying roller 84 then supplies a permanent adhesive to the inside surface of the boardstock for bonding to the outside of liner 42. Roller 84 is depicted of being of narrower width than boardstock 38 in order to prevent the application of adhesive to portions of the boardstock near the easy-open seam. This is particularly appropriate in the embodiments of the invention illustrated in FIG. 6. However, roller 122 can extend the full width of the boardstock 38 and thus apply permanent adhesive across the full width of the boardstock in all embodiments of the invention. This is particularly appropriate in embodiments of the invention employing a butt joint easy-open seam. Additionally, there is a roll 86 for supplying an adhesive resist coating to the outside of the bodywall boardstock layer. This adhesive resist can be employed for preventing permanent bonding of the outer label onto the bodywall of the container in the event, for example, that it is desirable that the entire label readily peel away from the can body.

The bodywall boardstock is then wound onto the mandrel on top of the continuous inner liner layer so that the leading edge of the boardstock either abuts the trailing edge thereof or overlaps the trailing edge thereof to provide respectively, either a butt jointed easy-open seam or overlapped easy-open seam. The bodywall/inner liner layer laminate is then longitudinally displaced to the left on mandrel 70 by means of a conventional belt conveyor 88.

The outer label is supplied via source 90. In one preferred embodiment of the invention, a portion of the leading longitudinal edge of the outer label sheet material can be treated to modify adhesion of the subsequently folded edge to the container bodywall as desired. With reference to FIG. 7, a portion 92 of the longitudinal edge near the predetermined end portion 94 of the outer label sheet is treated with an adhesive resist material while the remaining portion 93 of the leading longitudinal edge of the label is untreated. The adhesive resist applied to area 92 prevents this area following its subsequent folding and wrapping around the container body, from being adhered to the trailing edge 96 of the label thus providing an unbonded tab (Tab 26 in FIG. 1) for easy grasping by the consumer. Alternatively, area 94 of the preprinted label can have a heat activatable adhesive applied thereto during or subsequent to the printing process.

Folding and bonding of the leading longitudinal edge portion 98 of the outer label is accomplished first by applying a permanent adhesive to the underside of the leading longitudinal edge 98 via permanent adhesive supply roll 100. The label next passes across a folding means such as a folding tongue 102 wherein the longitudinal edge is folded and bonded to itself. In the event that the edge is to be folded one or more times further to provide a reinforced edge having more than two layers of flexible sheet material, additional adhesive supply rolls and edge folding means can be provided for the subsequent folding operations. In order that the label width be maintained exactly during the edge folding operation, an automatic width sensor and width adjustor can be employed. Such device can use electric, photoelectric or mechanical sensors to monitor label width and signal adjustments to the position of the label folding location. Such devices can be used in concert with the cross-matching devices which monitor a printed eye track in the conventional label winding operation as known to the skilled artisan.

Following folding and bonding of the longitudinal edge 98 of the outer label, the label is passed through a tab cutting means 104 which provides a short vertical cut 105 through all or a portion of the reinforced edge 20 of the outer label. The extent of cutting through the reinforced edge will be determined in part by the strength of the label material. With a weak label, a cut fully through the reinforced edge could cause tearing as the label is pulled toward the winder. A method and apparatus for forming the tab cut in the label sheet is disclosed in U.S. Pat. No. 4,091,718 to Thornhill. When the tab cut is made with a rotating knife blade rotation of the blade in a direction toward the leading edge of the label can cause the tab edge to stick upwardly from the label which is considered desirable. The outer label is next passed across an adhesive roll 106 which supplies a permanent or temporary adhesive to the underside of the outer label. As the outer label continues, it passes across an optional edge adhesive supply roll 108 wherein adhesive is coated on the underside of the reinforced longitudinal edge 20. As indicated previously, the adhesive is advantageously a weak adhesive such as a dextrine or the like. If the adhesive supplied via adhesive supply roll 108 is a thermally activatable adhesive, or if a thermally activatable adhesive has previously been applied to the edge of the label, an optional heater 110 is employed for heating of the adhesive layer prior to winding of the adhesive layer on the can body. An optional pressure roll, which may also be heated, presses the reinforced longitudinal edge 20 of the outer label onto the trailing edge 96 of the outer label thereby insuring that the overlapping reinforced edge 20 is bonded to the trailing edge 96 of the outer label.

The thus formed continuous container laminate is conveyed by belt conveyor 88 towards a cutting station 114 which includes a plurality of rotatably mounted knives 116 that circumferentially cut the tubular laminate into cylindrical sections or "can bodies" along the circumferential cuts defined by label ends 94 which may be printed or unprinted. Alternatively, the continuous laminate can be divided into desired longer length, (for example an eight can body length), and be removed from the mandrel 70 for severing into sections at another cutting station as desired. Although cutting station 114 is shown mounted on the winder bed, the cutting operation can also be and preferably is, accomplished by a secondary machine.

The severed can bodies are then transported to an end applying station or "seamer" 118 where closure members are applied to one end of the container bodies. Any of the end seam configurations for the closure member constructions described in U.S. application Ser. No. 07/621,219 filed Nov. 30, 1990 by Michael T. Drummond, et al. and entitled "Easy-Open Container for Refrigerated Dough Products and the Like", can be employed. These configurations include the "double-lock" construction in which the cylindrical end of the can body wall is flared prior to the seaming operation and folded into the peripheral crimp or seam in the closure member; the conventional crimped closure member construction in which the peripheral edge of the closure member is folded or crimped to provide a better gripping of the unfolded container body wall; or the "partial double lock" construction in which the can body end is flared only slightly prior to application of the closure member and in which the flared end of the can body extends only partially into the rolled edge of the closure member.

Figure 8:
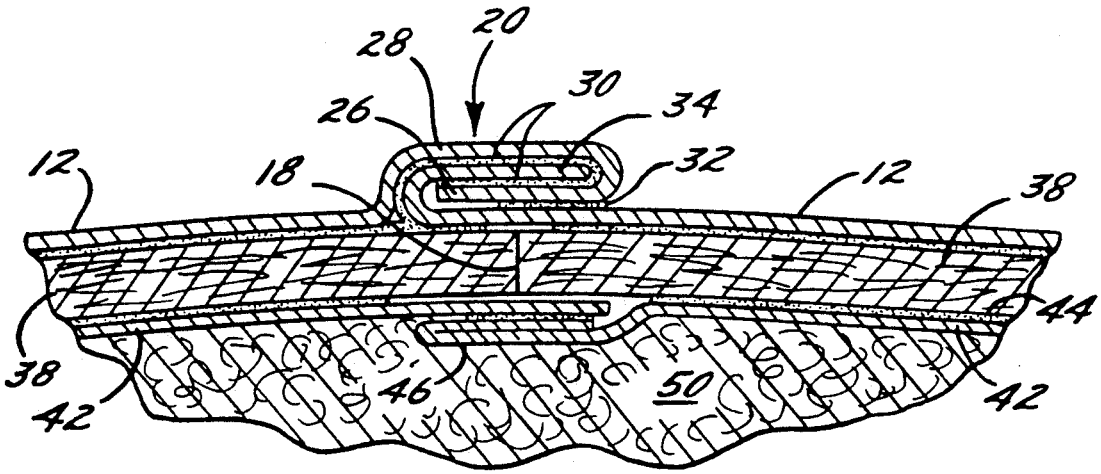
FIG. 8 is a greatly enlarged fragmentary cross-section view taken along the butt joint of an easy-open container according to the invention and illustrates an alternative construction for the outer label in which the reinforced edge of the outer label is interlocked with the other longitudinal edge of the label.

FIG. 8 illustrates an alternative construction for the easy-open containers of the invention. In this embodiment of the invention, the folded longitudinal edge 20 of the outer label 12 is interlocked with and permanently bonded to the trailing edge 34 of the outer label 12. The permanent adhesive layer 30 bonds both the underfolded edge 26 and the upper edge 28 of the reinforced longitudinal edge 20 of the outer label to the interlocked trailing edge 34 of the outer label. It will be seen that the trailing edge 34 of the outer label is also folded outwardly in order to form the interlocking structure with the leading reinforced edge 20 of the outer label.

Formation of an interlocking structure such as shown in FIG. 8 can be readily accomplished by employing a folding member such as member 74 or 102 of (FIG. 7) on the winding mandrel 70 at a location just prior to the pressure roll 112. Such a folding member is positioned to receive both the leading edge and the trailing edge of the outer label and to fold the two edges jointly into an interlocking structure. Other interlocking structures wherein at least one longitudinal edge is folded onto and bonded to itself via an interlocking layer interposed into the folded edge, are also considered to be within the scope of the invention.

In the illustrated embodiments of the invention, the outer label has been shown as being temporarily or permanently bonded on its underside, directly to the can body walls 38 on both sides of the easy-open joint. However, the bonding of the outer label to the can body can be varied depending upon the objectives of the container. Preferably, the outer label should be bonded to at least a portion of the can body wall 38 and the leading end of the reinforced edge 20 of the outer label should be bonded to a portion of the trailing edge of the outer label. However, the invention is widely variable; thus, for example, the folded and reinforced longitudinal edge of the outer label can readily be applied to the container body wall as the trailing edge of the label positioned in bridging relation to the easy-open seam and bonded permanently or temporarily to the bodywall on both sides of the easy-open seam. It is not considered necessary that the outer label be bonded to the can body wall at locations closely adjacent both sides of the easy-open seam. It is preferred however that the outer label be bonded to the container body wall 38 at locations closely adjacent the easy-open seam on one side thereof from end to end of the container, i.e. closely adjacent one side of the easy-open seam substantially along the entire length of the easy-open seam.

In any of its various embodiments, the containers of the invention can provide significant benefits and advantages including for example significantly decreased structural requirements for the outer label layer and/or significantly improved reinforcement for the easy-open seam for the container. The invention can allow for the use of outer label layers which are thinner and/or weaker than outer label layers employed in conventional easy-open containers. The invention can allow for the use of peelable, heat sealed adhesive bonds. The invention can provide containers in which the portion of the outer label covering the easy-open seam will be removed regardless of whether the consumer uses proper care in peeling of the outer label from the container. Nevertheless, the containers of the invention can be readily manufactured and do not require substantial investment in new manufacturing equipment and/or the addition of new components for the container body construction.

The invention has been described in considerable detail with reference to its preferred embodiments. However, it will be apparent that variations and modifications can be made within the spirit and scope of the invention as described in the foregoing detailed description and defined in the appended claims.

That which is claimed is:

1. An easy-open container comprising:

a helically wound paperboard bodywall defining a substantially cylindrical container body having opposed ends, the helically wound paperboard bodywall having its edges lying adjacent each other to thereby define an easy-open seam extending helically between the ends of the container body;

a helically wound outer label of flexible sheet material in strip form bonded to at least a portion of the outer surface of the bodywall, at least one longitudinal edge of the outer label being folded onto and bonded to the main body of the label to thereby provide a reinforced longitudinal edge portion comprising at least two layers of flexible sheet material;

the reinforced edge portion of the outer label being positioned in bridging relation to the easy-open seam of the bodywall substantially from end to end of the container body to thereby maintain the easy-open seam closed and provide a peel strip for exposing the easy-open seam for opening of the container body.

2. The easy-open container of claim 1 wherein at least a portion of the leading edge of the reinforced longitudinal edge portion of the outer label is bonded to at least a portion of the other longitudinal edge of the outer label.

3. The easy-open container defined in claim 2 wherein at least a portion of the underside of the leading edge of the reinforced longitudinal edge portion of the outer label is bonded to at least a portion of the outside of the other longitudinal edge of the outer label.

4. The easy-open container defined in claim 1 wherein a circumferential tab cut is provided through all or a portion of the reinforced longitudinal edge of the outer label at a location adjacent one end of the container to provide a tab for removal of the reinforced longitudinal edge portion of the outer label from the easy-open seam.

5. The easy-open container defined in claim 1 wherein the reinforced longitudinal edge portion of the outer label comprises at least three layers of the flexible sheet material and wherein said layers are bonded to each other.

6. The easy-open container defined in claim 1 wherein the easy-open seam extending helically between the ends of the container body is a butt joint.

7. The easy-open container of claim 1 wherein the adjacent edge of the helically wound bodywall are overlapped and a temporary adhesive is provided between the overlapped edges of the bodywall for releasibly adhering the overlapped edges of the bodywall together.

8. The easy-open container defined in claim 1 wherein at least a portion of the outer label is permanently bonded to the bodywall of the container.

9. The easy-open container defined in claim 1 wherein at least portion of the outer label is releasibly bonded to the bodywall of the container.

10. The easy-open container defined in claim 1 wherein the outer label is a sheet material constructed of a material selected from the group consisting of paper, kraft, plastic, film, foil or laminates of such material.

11. An easy-open container comprising:

a helically wound paperboard bodywall having its edges lying adjacent each other and defining a substantially cylindrical container body having opposed ends, the adjacent edges of the bodywall defining an easy-open seam extending helically between the ends of the container body;

a helically wound outer label of flexible sheet material in strip form bonded to at least a portion of the outer surface of the bodywall and being defined by two longitudinal edges, at least one longitudinal edge of the outer label being folded onto and bonded to the main body of the label to thereby provide a reinforced longitudinal edge portion comprising at least two layers of flexible sheet material;

the reinforced longitudinal edge portion of the outer label being positioned in bridging relation to the easy-open seam of the bodywall substantially from end to end of the container body with at least a portion of the reinforced edge portion being releasibly bonded to a portion of the outer label adjacent the other longitudinal edge of the outer label to thereby maintain the easy-open seam closed and provide a peel strip for exposing the easy-open seam for opening of the container body.

12. The easy-open container of claim 11 wherein the leading end of the reinforced longitudinal edge portion of the outer label is releasibly adhered to the portion of the outer label adjacent the other longitudinal edge of the outer label by a peelable heat seal.

13. The easy-open container defined in claim 11 wherein the leading end of the reinforced longitudinal edge portion of the outer label is releasibly bonded to the portion of the outer label adjacent the other longitudinal edge portion of the outer label by a frangible adhesive layer.

14. The easy-open container defined in claim 11 wherein the portion of the outer label adjacent the other longitudinal edge of the outer label is permanently bonded to the container bodywall adjacent the easy-open seam substantially from end to end of the container.

15. The easy-open container defined in claim 11 wherein the portion of the outer label adjacent the other longitudinal edge of the outer label is releasibly bonded to the outer surface of the container bodywall adjacent the helical easy-open seam substantially from end to end of the container body.

16. The easy-open container defined in claim 11 wherein at least a portion of the trailing end of the reinforced longitudinal edge is permanently bonded to the container bodywall.

17. The easy-open container defined in claim 11 wherein at least a portion of the trailing end of the reinforced longitudinal edge of the outer label is releasibly bonded to the bodywall.

18. The easy-open container defined in claim 11 wherein the outer label is constructed of flexible sheet material selected from the group consisting of paper, kraft, plastic film, film/foil laminates, paper/foil laminates and paper/film laminates.

19. The easy-open container defined in claim 11 wherein the reinforced longitudinal edge portion of the outer label comprises at least three layers of flexible sheet material bonded to each other.

20. The easy-open container defined in claim 11 wherein the adjacent edges of the helically wound paperboard bodywall form a butt joint extending helically from end to end of the container body.

21. The easy-open container defined in claim 11 wherein the adjacent edges of the helically wound bodywall are overlapped and a temporary adhesive is provided between the overlapped edges of the bodywall for releasibly adhering the overlapped edges of the bodywall together.

22. The easy-open container defined in claim 11 additionally comprising a flexible barrier sheet liner bonded to the inner surface of the cylindrical bodywall comprising an expandable fold extending helically between the ends of the container, the fold being positioned adjacent or overlapping the easy-open seam of the bodywall.

23. The easy-open container defined in claim 11 wherein the reinforced longitudinal edge portion of the outer label comprises a circumferential cut extending through the reinforced longitudinal edge portion of the outer label and continuing into a portion of the main body of the outer label.

24. The easy-open container defined in claim 23 wherein at least a portion of the reinforced longitudinal edge portion of the outer label adjacent the circumferential cut through the reinforced longitudinal edge portion is unbonded to the other longitudinal edge of the outer label.

25. A method for manufacturing an easy-open container comprising the steps:

spirally winding a continuous bodywall paperboard sheet onto a mandrel in edge adjacent relationship to form a continuous bodywall tube having a helical seam;

providing a continuous outer label sheet material having at least one longitudinal edge folded onto and bonded to the main body of the sheet to thereby provide a reinforced longitudinal edge portion comprising at least two layers of the flexible sheet material;

contacting at least a portion of one face of the outer label sheet with an adhesive material; and helically winding the continuous outer label sheet onto the continuous bodywall tube such that the reinforced longitudinal edge portion of the outer label flexible sheet is positioned in bridging relation to the helical seam of the continuous bodywall tube, and such that the adhesive material secures the outer label sheet to the bodywall tube.

26. The method defined in claim 25 wherein the step of providing the continuous outer label sheet having at least one longitudinal edge folded onto and bonded to the main body of the sheet comprises the steps of providing a continuous outer label sheet material in strip form; applying a permanent bonding agent to at least one longitudinal edge portion of one face of the continuous outer label sheet material and folding the longitudinal edge of the continuous sheet material onto the main body of the sheet material to thereby provide a reinforced longitudinal edge portion comprising at least two layers of the flexible sheet material.

27. The method defined in claim 25 wherein the helically winding of the continuous outer label sheet material onto the continuous bodywall tube is conducted by positioning the continuous outer label sheet such that the reinforced longitudinal edge portion thereof is positioned as the leading edge and wherein the other longitudinal edge is positioned on the continuous bodywall tube such that it is located closely adjacent the helical seam of the continuous bodywall tube and wherein the leading, reinforced longitudinal edge of the outer label is helically wound onto a portion of the outside surface of the other longitudinal edge of the outer label.

28. The method of claim 25 wherein the reinforced longitudinal edge portion of the outer label sheet material includes a heat activatable coating on its underside capable of forming a peelable bond and wherein the reinforced longitudinal edge portion is heated and the continuous outer label sheet is helically wound onto the continuous bodywall tube with application of pressure to the outside of the reinforced longitudinal edge portion of the outer label flexible sheet.

29. The method of claim 25 wherein the outer label flexible sheet material is constructed of a material selected from the group consisting of paper, kraft, plastic, film, foil or laminates of such materials.

* * * * *